US010818414B2

(12) United States Patent
Huang et al.

(10) Patent No.: US 10,818,414 B2
(45) Date of Patent: Oct. 27, 2020

(54) MOVABLE PART COMPOSITE CABLE

(71) Applicant: Hitachi Metals, Ltd., Tokyo (JP)

(72) Inventors: Detian Huang, Tokyo (JP); Yoshinori Tsukamoto, Tokyo (JP); Isao Matsuoka, Tokyo (JP); Masanori Kobayashi, Tokyo (JP); Masashi Moriyama, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/587,905

(22) Filed: Sep. 30, 2019

(65) Prior Publication Data

US 2020/0168364 A1 May 28, 2020

(30) Foreign Application Priority Data

Nov. 22, 2018 (JP) ..... 2018-219659

(51) Int. Cl.

| | |
|---|---|
| ***H01B 11/04*** | (2006.01) |
| ***H01B 9/04*** | (2006.01) |
| ***H01B 7/22*** | (2006.01) |
| ***H01B 7/02*** | (2006.01) |
| *H01B 7/04* | (2006.01) |

(52) U.S. Cl.

CPC ..... *H01B 9/04* (2013.01); *H01B 7/025* (2013.01); *H01B 7/228* (2013.01); *H01B 7/041* (2013.01)

(58) Field of Classification Search

CPC ..... H01B 5/08; H01B 11/04; H01B 11/06

See application file for complete search history.

(56) References Cited

U.S. PATENT DOCUMENTS 8,178,785 B2 * 5/2012 Grogl ..... H01B 11/1091 174/106 R
8,378,217 B2 * 2/2013 Sugiyama ..... H01B 11/203 174/113 R
9,508,467 B2 * 11/2016 Pon ..... H01B 9/003

(Continued)

FOREIGN PATENT DOCUMENTS

EP 408230 * 1/1991
JP 2016-110836 A 6/2016

*Primary Examiner* — Chau N Nguyen

(74) *Attorney, Agent, or Firm* — Roberts Calderon Safran & Cole P.C.

(57) ABSTRACT

A movable part composite cable includes a plurality of power supply wires being designed for electric power supply, which respectively include a plurality of insulated electric wires being laid together and being covered by each covering member, the plurality of power supply wires being arranged in contact with each other on surfaces of their respective covering members, one or more signal wires being designed for signal transmission, each signal wire having an outer diameter smaller than an outer diameter of each power supply wire, and a jacket, which is being provided over an outer periphery of an aggregate including the plurality of power supply wires and the one or more signal wires that are laid together. The power supply wires and the signal wires are not in direct contact with each other, or the power supply wires and the signal wires are in direct contact with each other with a contact area therebetween being smaller than a contact area between the power supply wires.

11 Claims, 2 Drawing Sheets

(56) References Cited

U.S. PATENT DOCUMENTS

| | | | | |
|---|---|---|---|---|
| 2003/0121694 | A1* | 7/2003 | Grogl | H01B 3/441<br>174/113 R |
| 2007/0044991 | A1* | 3/2007 | Varkey | H01B 7/046<br>174/102 R |
| 2018/0281706 | A1* | 10/2018 | Kobayashi | B60R 16/0215 |

* cited by examiner

MOVABLE PART COMPOSITE CABLE

CROSS-REFERENCE TO RELATED APPLICATION

The present invention is based on Japanese Patent Application No. 2018-219659 filed on Nov. 22, 2018, the entire contents of which are incorporated herein by reference.

BACKGROUND OF THE INVENTION

1. Field of the Invention

The present invention relates to a movable part composite cable.

2. Description of the Related Art

A movable part of a robot and the like is conventionally configured with motor driving power wires and signal wires being wired as each single body, and those power wires and signal wires are often wired while remaining bundled together with a binding member and the like so that electric wires or cables of each type configured as those power wires and signal wires are not moved or arranged separately from each other during movement of that movable part.

Note that JP-A-2016-110836 has been disclosed as prior art document information relevant to the invention of the present application.

[Patent Document 1] JP-A-2016-110836

SUMMARY OF THE INVENTION

When the electric wires or cables are wired to the movable part while remaining bundled together with a binding member and the like, there is a need to ensure a somewhat larger wiring space for those electric wires or cables in the movable part, because of an outer diameter increase in a bundled electric wire or cable portion. However, there is a demand to make the electric wire or cable wiring space smaller, because of a size decrease in a robot and the like in recent years.

In addition, with the electric wires or cables being wired while remaining bundled together with a binding member and the like, during use, when the power wires are pulled, for example, the signal wires are subjected to a pulling and the like in their bundled portions where the power wires and the signal wires are being bundled together, which may lead to deterioration in transmission properties of the signal wires. In particular, when a high frequency signal transmission is carried out by the signal wires, the influence of the deterioration of the transmission properties becomes pronounced.

Accordingly, it is an object of the present invention to provide a movable part composite cable, which is small in diameter so as to be able to be wired even in a small wiring space, and capable of suppressing the occurrence of deterioration in transmission properties during use.

For the purpose of solving the above-described problems, the present invention provides a movable part composite cable, comprising:

a plurality of power supply wires being designed for electric power supply, which respectively include a plurality of insulated electric wires being laid together and being covered by each covering member, the plurality of power supply wires being arranged in contact with each other on surfaces of their respective covering members;

one or more signal wires being designed for signal transmission, each signal wire having an outer diameter smaller than an outer diameter of each power supply wire; and a jacket, which is being provided over an outer periphery of an aggregate including the plurality of power supply wires and the one or more signal wires that are laid together, wherein the power supply wires and the signal wires are not in direct contact with each other, or the power supply wires and the signal wires are in direct contact with each other with a contact area therebetween being smaller than a contact area between the power supply wires.

POINTS OF THE INVENTION

According to the present invention, it is possible to provide the movable part composite cable, which is small in diameter so as to be able to be wired even in a small wiring space, and capable of suppressing the occurrence of deterioration in transmission properties during use.

DETAILED DESCRIPTION OF THE PREFERRED EMBODIMENTS

Embodiments

Several embodiments of the present invention will be described below in conjunction with the accompanying drawings.

Figure 1A:
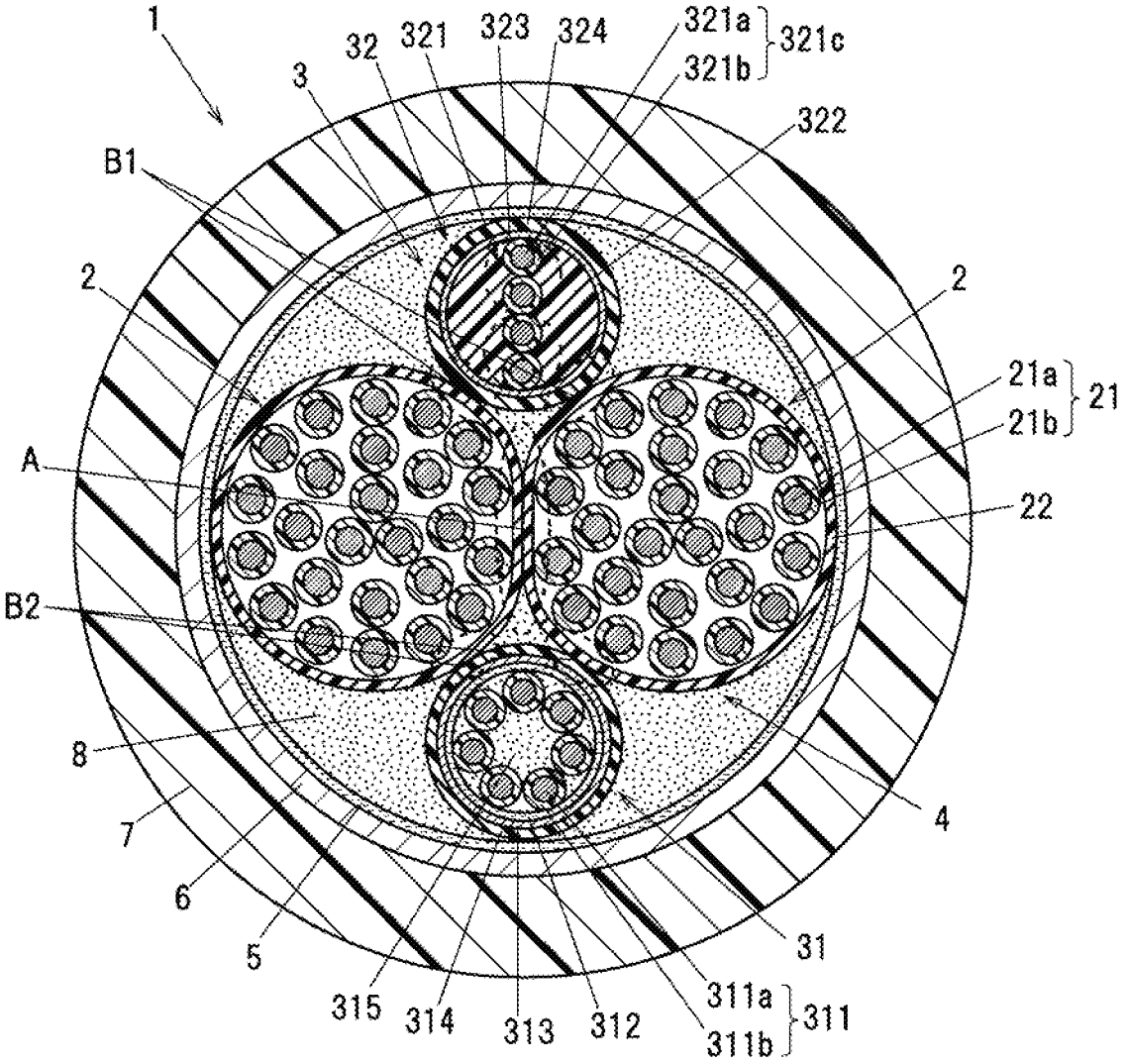
FIG. 1A is a cross-sectional view showing a cross section perpendicular to a longitudinal direction of a movable part composite cable according to one embodiment of the present invention.

FIG. 1A is a cross-sectional view showing a cross section perpendicular to a longitudinal direction of a movable part composite cable according to a first embodiment. A movable part composite cable 1 is being designed to be used as a wiring for a movable part of an industrial robot such as a robot arm and the like, for example.

Figure 1B:
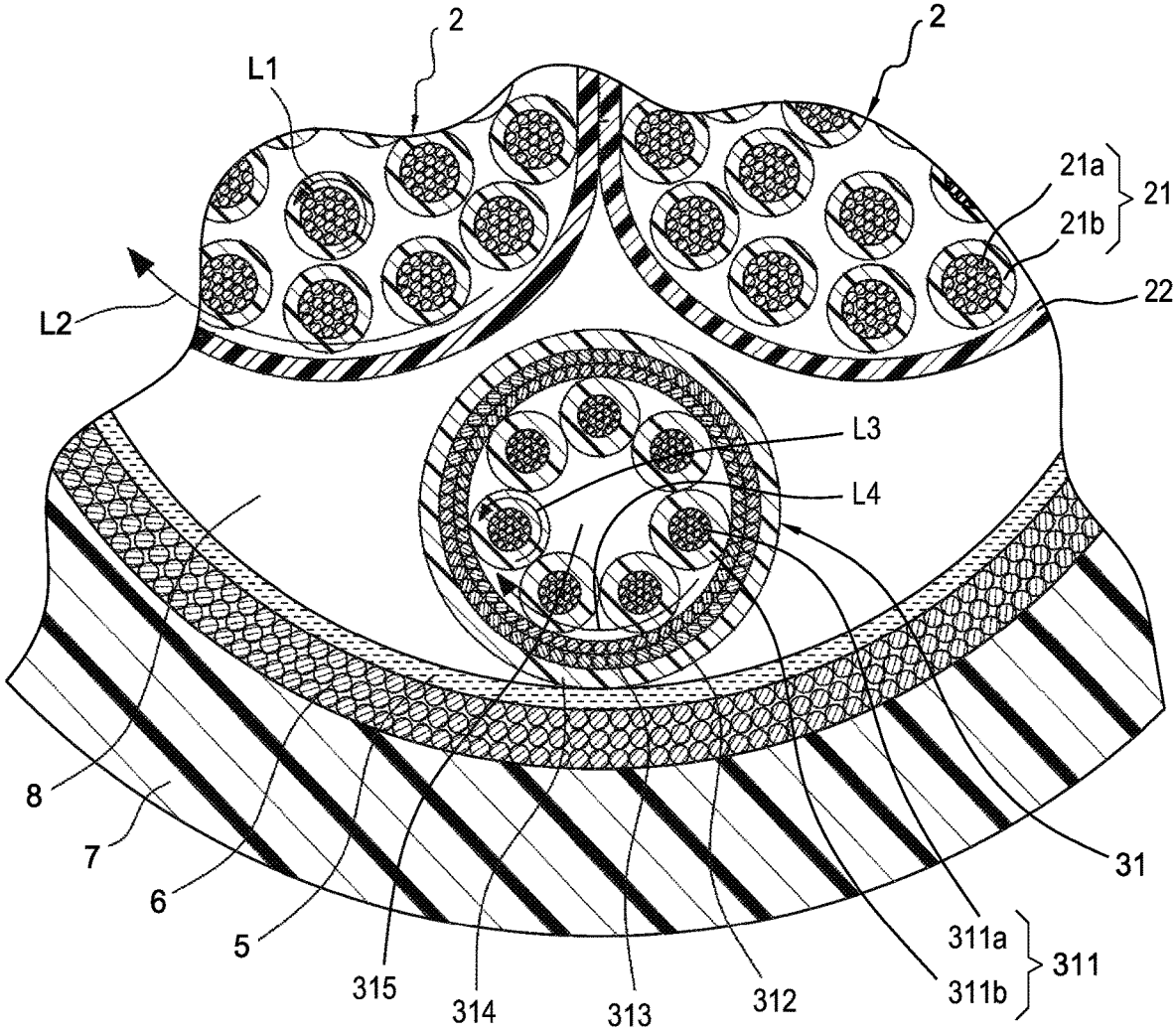
FIG. 1B is a partial, enlarged cross-sectional view of a movable part composite cable according to a second embodiment of the present invention.

As shown in FIG. 1A, the movable part composite cable 1 is configured to include a plurality of power wires 2, which are being designed for electric power supply, one or more signal wires 3, which are being designed for signal transmission and which are respectively smaller in outer diameter than the power wires 2, a binder tape 5, which is being wrapped around an outer periphery of an aggregate 4 being formed by laying the plurality of power wires 2 and the one or more signal wires 3 together, and a jacket 7, which is covering an outer periphery of the binder tape 5. An outer diameter of the movable part composite cable 1 having the above described structure is on the order of e.g. 15 mm to 17 mm The power wires 2 are respectively configured to include a plurality of insulated electric wires being laid together 21, and each resin tape 22, which is configured as each covering member and being wrapped around a periphery of the respective plurality of insulated electric wires 21 to cover the respective plurality of insulated electric wires 21 together. Although, as the covering members 22 for the power wires 2, it is possible to use a member which is being designed for the purpose of being able to make the outer diameters of the power wires 2 smaller, and being easily subjected to a stress and a resulting deformation in a contact portion between the plurality of power wires 2, that purpose can easily be achieved especially by using the resin tapes 22 to cover their respective pluralities of insulated electric wires 21. It is preferable that the resin tapes 22 be wrapped in such a manner that their respective inner surfaces are in direct contact with surfaces of their respective insulated electric wires 21. Each of the insulated electric wires 21 constituting the power wires 2 is being designed to be used for low speed electric power supply signal transmission, such as driving current supply to drive a motor (e.g., an actuator and the like), and the like. Each of the insulated electric wires 21 is being formed by coating an outer periphery of each stranded wire conductor 21*a* (as shown in FIG. 1B) composed of laid wires made of an electrical conductor such as copper or the like, with each insulating material 21*b*. It is preferable that the respective insulating materials 21*b* of the insulated electric wires 21 of the power wires 2 are smaller in thickness than insulating materials 311*b* of a control signal wire 31 described later and insulating materials 321*b* of a communication wire 32 described later (this difference in thickness shown in FIG. 1B). The thicknesses of the insulating materials 21*b* are configured to be e.g. 0.12 mm or less. Configuring the insulating materials 21*b* to have the above thicknesses makes the power wires 2 effective both in making the outer diameters of the power wires 2 greater than those of the signal wires 3 to allow a stress such as a bending stress and the like to be concentrated in the power wires 2, and in making the outer diameter of the movable part composite cable 1 smaller. Note that the power wires 2 are shown as one aspect of power supply wires of the present invention.

Although herein are shown two of the power wires 2 being used with each of those two power wires 2 including twenty five of its own insulated electric wires 21, the number of the power wires 2 and the number of the insulated electric wires 21 constituting each of the power wires 2 are not limited to the above numbers. Further, in order to suppress the occurrence of an uneven laying in laying the plurality of the power wires 2 together, it is desirable to configure the outer diameters of the power wires 2 to be substantially the same. Specifically, the outer diameter of one of the power wires 2 may be not less than 80% and not more than 120% of the outer diameter of the other of the power wires 2. Note that the outer diameters of the power wires 2 referred to herein refer to the outer diameters in such a condition that the power wires 2 are in a circular outer shape in a cross sectional view, not being deformed by an external force.

The respective resin tapes 22 of the power wires 2 act both to bundle their respective insulated electric wires 21 together so that their respective insulated electric wires 21 are not unlaid, and to, during bending, make the power wires 2 highly slidable between the adjacent electric wires or cables (between the two power wires 2 and between the power wires 2 and the signal wires 3), and between the power wires 2 and their respective insulated electric wires 21 in contact with the inner surfaces of their respective resin tapes 22, to thereby suppress the occurrence of abrasion due to repeated bendings. As the resin tapes 22, an abrasion resistant and highly slidable material may be used, and a tape which is made of a nylon, or a fluorine resin such as a PTFE (polytetrafluoroethylene), an ETFE (tetrafluoroethylene-ethylene copolymer) or the like can be used, for example. The pluralities of insulated electric wires 21 bundled together in the resin tapes 22 can be moved relatively freely relative to each other within the resin tapes 22, respectively.

The signal wires 3 are configured to include a control signal wire 31, which is being designed for control signal transmission, and a communication wire (a LAN cable) 32, which is being designed for data communication. Although herein are described one of the control signal wire 31 and one of the communication wire 32 being included as the signal wires 3, the number of the control signal wires 31 and the number of the communication wires 32 are not limited to the above numbers. For example, only the communication wire 32 or only the control signal wire 31 may be included as the signal wires 3.

The control signal wire 31 and the communication wire 32 configured as the signal wires 3 are configured to be smaller in outer diameter than the power wires 2. More specifically, the outer diameters of the control signal wire 31 and the communication wire 32 configured as the signal wires 3 are not more than 70% of the outer diameters of the power wires 2. In the present embodiment, as will be described in detail later, the stress in bending is concentrated in the power wires 2 each having such a large outer diameter that their transmission properties are not easily deteriorated even by being subjected to the stress, to thereby reduce the stress to be exerted on the signal wires 3 each having such a small outer diameter that their transmission properties are easily varied.

Further, in the present embodiment, the outer diameters of the control signal wire 31 and the communication wire 32 are being adjusted to be substantially the same. Specifically, the outer diameter of the control signal wire 31 is being set at not less than 80% and not more than 120% of the outer diameter of the communication wire 32. By configuring the outer diameters of the control signal wire 31 and the communication wire 32 to be substantially the same, the signal wires 3 have such even outer diameters as to be able to suppress the occurrence of a direction in which the signal wires 3 are difficult to bend, or the occurrence of an uneven laying in laying the signal wires 3.

Note that, in the event of an uneven laying in laying the power wires 2 and the signal wires 3 together, when the movable part composite cable 1 is cut to a predetermined length, a difference between the lengths of the power wires 2 or the signal wires 3 included in the movable part composite cable 1 occurs, which may lead to a failure such as a lag in signal receiving timing and the like. By arranging the power wires 2 and the signal wires 3 in a well-balanced manner, it is possible to suppress the occurrence of such a failure that the stress is concentrated in some of the electric wires during bending of the movable part composite cable 1, and it is therefore possible to suppress the occurrence of a failure such as a wire break and the like due to being subjected to repeated bendings, and thereby make the movable part composite cable 1 long life.

The control signal wire 31 is being designed for control signal transmission to be used in control of various devices, such as control of an air injector, for example, to at least carry out a higher speed signal transmission than the power wires 2. The control signal wire 31 is being formed by laying insulated electric wires 311 each having each insulating material 311*b* around a periphery of each stranded wire conductor 311*a* composed of laid wires (each wire has an outer diameter of e.g. 0.1 mm or less) made of an electrical conductor such as copper or the like, and in turn providing a binder tape 312, a shield layer 313, and a sheath 314 over an outer periphery of those laid insulated electric wires 311. The binder tape 312 is made of e.g. a paper, a non-woven fabric cloth, or the like. The shield layer 313 is made of a braided shield composed of braided metal wires. The shield layer 313 is shown as one aspect of a signal wire side shield layer of the present invention.

As the insulating materials 311*b*, it is possible to use a material made of a fluorine resin such as an ETFE (tetrafluoroethylene-ethylene copolymer), an FEP (tetrafluoroethylene-hexafluoropropylene copolymer), a PFA (tetrafluoroethylene-perfluoroalkylvinylether copolymer) or the like, for example. Further, the insulating materials 311*b* have a thickness of e.g. 0.15 mm or less. Since the control signal wire 31 can be configured small in diameter by using the above insulating materials 311*b* in the insulated electric wires 311, it is possible to reduce the diameter of the movable part composite cable 1 to such a size as to facilitate the wiring of the movable part composite cable 1 in a small wiring space.

In the present embodiment, the control signal wire 31 is being formed by locating a filling member 315 in the center of the cable 1, and laying seven of the insulated electric wires 311 helically on an outer periphery of that filling member 315, and in turn providing the binder tape 312, the shield layer 313, and the sheath 314 over the outer periphery of those seven insulated electric wires 311. The filling member 315 is disposed in the center of the cable 1 for the purpose of adjusting the outer diameter of the control signal wire 31 to be substantially equal to the outer diameter of the communication wire 32, and further reducing the stress in bending to be exerted on the insulated electric wires 311. As the filling member 315, it is possible to use a thread-like member such as a staple fiber yarn or the like, for example. Note that the thread-like member to be used as the filling member 315 is not limited to that staple fiber yarn, but that it is possible to use the thread-like member made of a string, a paper, a non-woven fabric cloth, or the like, for example, as the filling member 315. Further, the filling member 315 is not limited to the thread-like member, but, for example, a strip-like member may be used as the filling member 315.

The communication wire 32 is designed for digital signal transmission to be used for data communication, and configured as a category 5*e* to category 7 LAN cable, for example. The communication wire 32 is used to carry out a high frequency signal transmission of 1 MHz or higher and not higher than 600 MHz. The communication wire 32 has a characteristic impedance of e.g. 100Ω. The communication wire 32 is being formed by laying two twisted wire pairs 321 designed as communication wires, and covering peripheries of those two twisted wire pairs 321 together with an inner sheath 322, and in turn providing a shield layer 323 made of a braided shield composed of braided metal wires, and a sheath 324 made of a polyvinyl chloride (PVC) resin or the like over an outer periphery of that inner sheath 322. The shield layer 323 is shown as one aspect of the signal wire side shield layer of the present invention.

The twisted wire pairs 321 designed as communication wires are respectively being formed by twisting a pair of insulated electric wires 321*c* each having each insulating material 321*b* made of a foamed resin such as a foamed propylene, a foamed polyethylene or the like around a periphery of each stranded wire conductor 321*a* composed of a plurality of laid wires (each wire has an outer diameter of e.g. 0.1 mm or less) made of an electrical conductor such as copper or the like. By using the resin made of a foamed propylene or a foamed polyethylene as the foamed resin constituting the insulating materials 321*b*, it is possible to lower the relative permittivity of the insulating materials 321*b* with the thicknesses of the insulating materials 321*b* being reduced (to e.g. 0.3 mm or less), and thereby enhance the transmission properties at high frequencies. When the foamed resin is used as the insulating materials 321*b*, the transmission properties are easily deteriorated by a deformation due to an external force, but in the present embodiment, since the communication wire 32 is configured in such a manner as to resist being subjected to the stress in bending (described in detail later), it is possible to use the foamed resin in the insulating materials 321*b*. Note that the foamed resin to be used in the insulating materials 321*b* may be crosslinked.

The aggregate 4 is being formed by laying the two power wires 2 and the two signal wires 3 (the control signal wire 31 and the communication wire 32) together. In the present embodiment, in order to bring its cross-sectional shape closer to a circular shape, the aggregate 4 is being formed by laying the two power wires 2, the two signal wires 3 and the filling member 8 together. As the filling member 8, it is possible to use a thread-like member such as a staple fiber yarn or the like, for example. The staple fiber yarn is suitable for the filling member 8 of the movable part composite cable 1 to be used for the movable part because that staple fiber yarn has such a proper cushioning performance that no fracture occurs even by bending. Note that the thread-like member to be used as the filling member 8 is not limited to that staple fiber yarn, but that it is possible to use the thread-like member made of a string, a paper, a non-woven fabric cloth, or the like, for example, as the filling member. Further, the filling member 8 is not limited to the thread-like member, but, for example, a strip-like member may be used as the filling member 8. The filling member 8 also acts to impart its cushioning performance in such a manner as to disperse the stress in bending to be exerted on the signal wires 3 and suppress the occurrence of deterioration in the transmission properties of the signal wires 3.

Even when the movable section composite cable 1 is configured small in diameter, in order for the signal wires 3 to resist being subjected to the stress in bending, it is preferable to impregnate spaces between the two power wires 2 and the signal wires 3 (i.e., valley sections formed by bringing the power wires 2 into contact with each other) with the filling member 8.

In the movable section composite cable 1 according to the present embodiment shown in FIG. 1A, the power wires 2 and the signal wires 3 are in direct contact with each other, but in this case, contact areas (contact areas per unit length) B1 and B2 between the power wires 2 and the signal wires 3 are configured to be smaller than a contact area (contact area per unit length) A between the power wires 2. In the present embodiment, the aggregate 4 is configured with the power wires 2 being laid together in such a manner as to be compressed and flattened against each other. Further, by allowing the signal wires 3 to be acted on by the minimized load in laying, the signal wires 3 are respectively configured to have such a cross-sectional shape as to be equivalent to its cross-sectional shape in a no-load condition (a condition when acted on by no external force). Note that the contact area B1 refers to a total value of the contact areas between the two power wires 2 and the communication wire 32, while the contact area B2 refers to a total value of the contact areas between the two power wires 2 and the control signal wire 31. The contact area A between the power wires 2 is greater than the contact area B1, and greater than the contact area B2.

In the movable part composite cable 1, the relationships (A<B1 and A<B2) between the contact area A and the contact areas B1 and B2 are being established at any position in the longitudinal direction of the movable part composite cable 1. In other words, in the movable part composite cable 1, the relationships (A<B1 and A<B2) between the contact area A and the contact areas B1 and B2 is being established continuously in the longitudinal direction of the cable 1.

The aggregate 4 is configured in such a manner that the control signal wire 31 and the communication wire 32 can be moved independently of the plurality of power wires 2 during bending since the control signal wire 31 and the communication wire 32 are not being pressed against the power wires 2. Thus, most of the stress in bending is exerted on the power wires 2, while the signal wires 3 becomes resistant to being subjected to the stress in bending. As a result, it is possible to suppress the occurrence of a deformation of the cross-sectional shape of the signal wires 3 during bending, and it is therefore possible to suppress the occurrence of deterioration in the transmission properties of the signal wires 3 designed to carry out a relatively high speed signal transmission.

Note that, although, in the present embodiment shown in FIG. 1A, the power wires 2 and the signal wires 3 have been described as being in direct contact with each other, the power wires 2 and the signal wires 3 may be not in direct contact with each other as shown in FIG. 1B. In this case, the power wires 2 and the signal wires 3 may be in indirect contact with each other with the filling member 8 being located therebetween. It should be noted that the structural details of the FIG. 1A and FIG. 1B embodiments are the same, with the exception that the power wires 2 and signal wires 3 are in indirect contact with each other in the FIG. 1B embodiment.

With reference now to FIG. 1B, a lay direction L1 of each of the stranded wire conductors 21*a* of the power wires 2 may be configured to be an opposite direction to a lay direction L2 of the respective plurality of the insulated electric wires 21 of each of the power wires 2, while the lay direction L2 of the respective plurality of the insulated electric wires 21 of each of the power wires 2 may be configured to be an opposite direction to a lay direction of the aggregate 4. The lay direction L1 of each of the stranded wire conductors 21*a* is the same as the lay direction of the aggregate 4. This is because, if the lay direction L2 of the respective plurality of the insulated electric wires 21 of each of the power wires 2 is the same as the lay direction L1 of each of the stranded wire conductors 21*a* and the lay direction of the aggregate 4, the strands constituting the stranded wire conductors 21*a* are repeatedly twisted in the same direction, which may lead to strand necking and fracture during bending and the like. By configuring the lay direction L2 of the respective plurality of the insulated electric wires 21 of each of the power wires 2 in the opposite direction to the lay direction L1 of each of the stranded wire conductors 21*a* and the lay direction of the aggregate 4, it is possible to suppress the occurrence of wire break of the strands and enhance the resistance to bending.

Note that the lay direction L1 of each of the stranded wire conductors 21*a* is defined as the direction in which the constituent strands of the stranded wire conductor 21*a*, when observed from one end side of the insulated electric wire 21, are turning from the other end side of the insulated electric wire 21 to that one end side. The lay direction L2 of the respective plurality of the insulated electric wires 21 of each of the power wires 2 is defined as the direction in which the insulated electric wires 21, when observed from one end side of the power wire 2, are turning from the other end side of the power wire 2 to that one end side. Further, the lay direction of the aggregate 4 is defined as the direction in which the power wires 2 and the signal wires 3, when observed from one end side of the aggregate 4, are turning from the other end side of the aggregate 4 to that one end side.

Likewise, a lay direction L3 of each of the stranded wire conductors 311*a* of the control signal wire 31 may be configured to be an opposite direction to a lay direction L4 of the insulated electric wires 311 of the control signal wire 31, while the lay direction L4 of the insulated electric wires 311 of the control signal wire 31 may be configured to be an opposite direction to the lay direction of the aggregate 4. Note that the lay direction L3 of each of the stranded wire conductors 311*a* is defined as the direction in which the constituent strands of the stranded wire conductor 311*a*, when observed from one end side of the insulated electric wire 311, are turning from the other end side of the insulated electric wire 311 to that one end side. The lay direction L4 of the insulated electric wires 311 of the control signal wire 31 is defined as the direction in which the insulated electric wires 311, when observed from one end side of the control signal wire 31, are turning from the other end side of the control signal wire 31 to that one end side.

Further, likewise, a lay direction of each of the stranded wire conductors 321*a* of the communication wire 32 may be configured to be an opposite direction to a lay direction of the twisted wire pairs 321 of the communication wire 32, while the lay direction of the twisted wire pairs 321 of the communication wire 32 may be configured to be an opposite direction to the lay direction of the aggregate 4. Note that the lay direction of each of the stranded wire conductors 321*a* is defined as the direction in which the constituent strands of the stranded wire conductor 321*a*, when observed from one end side of the insulated electric wire 321*c*, are turning from the other end side of the insulated electric wire 321*c* to that one end side. The lay direction of the twisted wire pairs 321 of the communication wire 32 is defined as the direction in which the insulated electric wires 321*c*, when observed from one end side of the twisted wire pair 321, are turning from the other end side of the twisted wire pair 321 to that one end side.

The binder tape 5 is being helically wrapped around a periphery of the aggregate 4 in such a manner as to be contiguous to parts of the surfaces of the power wires 2 and the signal wires 3. A paper tape, a tape made of non-woven fabric cloth, or the like can be used as the binder tape 5. A shield layer 6, which is configured as a bundle shield layer made of a braided shield composed of braided metal wires is being provided around a periphery of the binder tape 5. A jacket 7 made of an insulating material is being provided over a periphery of the shield layer 6. As the jacket 7, it is possible to use the jacket made of a polyvinyl chloride (PVC) resin, a polyurethane (PU) resin or the like, for example, so as to protect the movable part composite cable 1 from an external force.

It is preferable that the shield layer 6 is configured in such a manner that outer diameters of the metal wires constituting the braided shield of the shield layer 6 are greater (e.g., 1.5 times or greater) than outer diameters of the metal wires constituting the braided shields 313 and 323 provided in the signal wires 3 (the control signal wire 31 and the communication wire 32). Further, it is preferable that a thickness of the shield layer 6 is configured to be greater than thicknesses of the shield layer 313 and the shield layer 323. By configuring the shield layer 6 to be made of the above braided shield, even when employing such a structure as to provide the power wires 2 with no shield layer in order to make the outer diameter of the movable part composite cable 1 smaller while making the outer diameters of the power wires 2 greater than those of the signal wires 3, it is possible to suppress a low frequency noise from a motor and the like to which the power wires 2 are connected, from being received by the power wires 2.

In order to protect the movable part composite cable 1 from an external force, it is preferable that the jacket 7 is configured in such a manner as to be greater in thickness than the insulating materials 21*b* and the resin tapes 22 constituting the power wires 2, the insulating materials 311*b*, the insulating materials 321*b*, the sheath 314 and the sheath 324 constituting the signal wires 3, and the shield layer 6.

All the electric wires, i.e., each of the two power wires 2 and each of the two signal wires 3 are in contact with an inner peripheral surface of the binder tape 5. The binder tape 5 is being wrapped by appropriately adjusting the amount and arrangement of the filling member 8, so that the binder tape 5 is substantially circular in a cross sectional view.

Operations and Advantageous Effects of the Embodiments

As described above, in the movable section composite cable 1 according to the present embodiment, the power wires 2 and the signal wires 3 are not in direct contact with each other (as shown in FIG. 1B), or the power wires 2 and the signal wires 3 are in direct contact with each other (as shown in FIG. 1A) with the contact areas B1 and B2 between the power wires 2 and the signal wires 3 being smaller than the contact area A between the power wires 2.

For example, if the contact area B between the power wires 2 and the signal wire 3 is larger than the contact area A between the power wires 2, that signal wire 3 is easily subjected to the stress in bending and a resulting deformation, and the transmission properties are easily deteriorated. In the present embodiment, by configuring the contact areas B1 and B2 between the power wires 2 and the signal wires 3 to be smaller than the contact area A between the power wires 2 (or by bringing the power wires 2 and the signal wires 3 into no contact with each other), and by strongly pressing the power wires 2 against each other, it is possible to allow the stress in bending to be concentrated in the power wires 2 and thereby reduce the stress in bending to be exerted on the signal wires 3.

Besides, typically, in a cable wired in the movable part, since the stress in bending is concentrated in a member located in a center of that cable, it is often the case that no electric wire is located in the central portion of that cable. In this case, however, the space in the central portion of the cable becomes wasted, and the cable becomes large (e.g. 20 mm or more) in outer diameter. Accordingly, in the present embodiment, instead of locating no electric wire in the central portion of the cable, the power wires 2 are being located in the central portion of the cable. That is, in the present embodiment, the cable has such a structure that the contact point where the power wires 2 are brought into direct contact with each other is being located in the central portion of the cable. In the present embodiment, by employing such a cable structure, it is possible to effectively utilize the wasted space in the central portion of the cable and it is therefore possible to reduce the diameter of the entire movable part composite cable 1. Further, in the present embodiment, by employing such a cable structure, since it is possible to allow the stress in bending to be concentrated in the power wires 2 and thereby reduce the stress in bending to be exerted on the signal wires 3, it is possible to suppress the occurrence of deterioration in the transmission properties of the signal wires 3 during bending.

Although the stress in bending becomes concentrated in the power wires 2 arranged in the center of the cable, since the power wires 2 are being designed for a low speed signal (power supply signal) transmission such as a motor driving current transmission, the transmission properties are substantially unaffected even by being subjected to the stress. Furthermore, since the power wires 2 are configured to allow the insulated electric wires 21 to be moved relatively freely within the resin tapes 22, the insulated electric wires 21 when subjected to the stress in bending are moved within the resin tapes 22 to thereby be able to disperse that stress.

As described above, according to the present embodiment, it is possible to achieve the movable part composite cable 1, which is small in diameter so as to be able to be wired even in a small wiring space, and capable of suppressing the occurrence of deterioration in the transmission properties during use.

SUMMARY OF THE EMBODIMENTS

Next, the technical ideas grasped from the above-described first and second embodiments will be described with the aid of the reference characters and the like in the embodiments. It should be noted, however, that each of the reference characters and the like in the following descriptions is not to be construed as limiting the constituent elements in the claims to the members and the like specifically shown in the embodiments.

[1] A movable part composite cable (1), comprising: a plurality of power supply wires (2) being designed for electric power supply, which respectively include a plurality of insulated electric wires being laid together (21) and being covered by each covering member (22), the plurality of power supply wires (2) being arranged in contact with each other on surfaces of their respective covering members (22); one or more signal wires (3) being designed for signal transmission, each signal wire having an outer diameter smaller than an outer diameter of each power supply wire (2); and a jacket (7), which is being provided over an outer periphery of an aggregate (4) including the plurality of power supply wires (2) and the one or more signal wires (3) that are laid together, wherein the power supply wires (2) and the signal wires (3) are not in direct contact with each other, or the power supply wires (2) and the signal wires (3) are in direct contact with each other with a contact area (B1, B2) therebetween being smaller than a contact area (A) between the power supply wires (2).

[2] The movable part composite cable (1) according to [1] above, wherein the outer diameter of the signal wire (3) is not more than 70% of the outer diameter of the power supply wire (2).

[3] The movable part composite cable (1) according to [1] or [2] above, wherein the covering member (22) comprises a resin tape (22) which is being wrapped around the plurality of insulated electric wires (21).

[4] The movable part composite cable (1) according to any one of [1] to [3] above, wherein the power supply wires (2) are being laid together in such a manner that their respective pluralities of insulated electric wires (21) can be moved relative to each other within their respective covering members (22).

[5] The movable part composite cable (1) according to any one of [1] to [4] above, wherein each insulated electric wire (21) of the respective pluralities of insulated electric wires (21) of the power supply wires (2) comprises a stranded wire conductor (21*a*) and an insulating material (21*b*) coating a periphery of the stranded wire conductor (21*a*), wherein a lay direction of the plurality of insulated electric wires (21) of each of the power supply wires (2) is configured to be an opposite direction to a lay direction of each stranded wire conductor (21*a*) and a lay direction of the aggregate (4).

[6] The movable part composite cable (1) according to any one of [1] to [5] above, wherein the aggregate (4) is configured with the power supply wires (2) being laid together in such a manner as to be compressed and flattened against each other.

[7] The movable part composite cable (1) according to any one of [1] to [6] above, wherein the signal wires (3) include a communication wire (32), which is being designed for data communication.

[8] The movable part composite cable (1) according to any one of [1] to [7] above, wherein each of the power supply wires (2) and each of the signal wires (3) are in contact with an inner peripheral surface of a binder tape (5), which is being wrapped around the outer periphery of the aggregate (4).

[9] The movable part composite cable (1) according to any one of [1] to [8] above, wherein each signal wire (3) includes a plurality of insulated electric wires (311, 321), each of which comprises a stranded wire conductor (311*a*, 321*a*) and an insulating material (311*b*, 321*b*) coating a periphery of the stranded wire conductor (311*a*, 321*a*), wherein a lay direction of the plurality of insulated electric wires (311, 321) of each of the signal wires (3) is configured to be an opposite direction to a lay direction of each stranded wire conductor (311*a*, 321*a*) of the insulated electric wires (311, 321) and a lay direction of the aggregate (4).

[10] The movable part composite cable (1) according to any one of [1] to [9] above, wherein each insulated electric wire (21) of the pluralities of insulated electric wires (21) of the power supply wires (2) comprises a stranded wire conductor (21*a*) and an insulating material (21*b*) coating a periphery of the stranded wire conductor (21*a*), wherein each of the signal wires (3) comprises a plurality of insulated electric wires (311, 321) each of which comprises a stranded wire conductor (311*a*, 321*a*) and an insulating material (311*b*, 321*b*) coating a periphery of the stranded wire conductor (311*a*, 321*a*), wherein a thickness of the insulating material (21*b*) of the insulated electric wire (21) constituting the power supply wire (2) is smaller than a thickness of the insulating material (311*b*, 321*b*) of the insulated electric wire (311, 321) constituting the signal wire (3).

[11] The movable part composite cable (1) according to any one of [1] to [10] above, further comprising a bundle shield layer (6) comprising a braided shield composed of braided metal wires, and being provided over the outer periphery of the aggregate (4), wherein each of the signal wires (3) includes a plurality of insulated electric wires being laid together (311, 321), and a signal wire side shield layer (313, 323) comprising a braided shield composed of braided metal wires and being provided over an outer periphery of the plurality of insulated electric wires (311, 321), wherein a thickness of the bundle shield layer (6) is greater than thicknesses of the respective signal wire side shield layers (313, 323) of the signal wires (3).

[12] The movable part composite cable (1) according to any one of [1] to [11] above, further comprising: a bundle shield layer (6) comprising a braided shield composed of braided metal wires and being provided over the outer periphery of the aggregate (4), wherein each of the signal wires (3) includes a plurality of insulated electric wires being laid together (311, 321), and a signal wire side shield layer (313, 323) comprising a braided shield composed of braided metal wires and being provided over an outer periphery of the plurality of insulated electric wires (311, 321), wherein outer diameters of the metal wires constituting the bundle shield layer (6) are greater than outer diameters of the metal wires constituting the respective signal wire side shield layers (313, 323) of the signal wires (3).

Although the embodiments of the present invention have been described above, the above described embodiments are not to be construed as limiting the inventions according to the claims. Further, it should be noted that not all the combinations of the features described in the embodiments are indispensable to the means for solving the problem of the invention. Further, the present invention can appropriately be modified and implemented without departing from the spirit thereof.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A movable part composite cable, comprising:

a plurality of power supply wires being designed for electric power supply, which respectively include a plurality of insulated electric wires being laid together and being covered by each covering member, the plurality of power supply wires being arranged in contact with each other on surfaces of their respective covering members;

one or more signal wires being designed for signal transmission, each signal wire having an outer diameter smaller than an outer diameter of each power supply wire; and a jacket, which is being provided over an outer periphery of an aggregate including the plurality of power supply wires and the one or more signal wires that are laid together, wherein the power supply wires and the signal wires are not in direct contact with each other, or the power supply wires and the signal wires are in direct contact with each other with a contact area therebetween being smaller than a contact area between the power supply wires, wherein each insulated electric wire of the pluralities of insulated electric wires of the power supply wires comprises a stranded wire conductor and an insulating material coating a periphery of the stranded wire conductor, and wherein a lay direction of the plurality of insulated electric wires of each of the power supply wires is configured to be an opposite direction to a lay direction of each stranded wire conductor and a lay direction of the aggregate.

2. The movable part composite cable according to claim 1, wherein the outer diameter of the signal wire is not more than 70% of the outer diameter of the power supply wire.

3. The movable part composite cable according to claim 1, wherein the covering member comprises a resin tape which is being wrapped around the plurality of insulated electric wires.

4. The movable part composite cable according to claim 1, wherein the power supply wires are being laid together in such a manner that their respective pluralities of insulated electric wires can be moved relative to each other within their respective covering members.

5. The movable part composite cable according to claim 1, wherein the aggregate is configured with the power supply wires being laid together in such a manner as to be compressed and flattened against each other.

6. The movable part composite cable according to claim 1, wherein the signal wires include a communication wire, which is being designed for data communication.

7. The movable part composite cable according to claim 1, wherein each of the power supply wires and each of the signal wires are in contact with an inner peripheral surface of a binder tape, which is being wrapped around the outer periphery of the aggregate.

8. The movable part composite cable according to claim 1, wherein each insulated electric wire of the pluralities of insulated electric wires of the power supply wires comprises a stranded wire conductor and an insulating material coating a periphery of the stranded wire conductor, wherein each of the signal wires comprises a plurality of insulated electric wires, each of which comprises a stranded wire conductor and an insulating material coating a periphery of the stranded wire conductor, wherein a thickness of the insulating material of the insulated electric wire constituting the power supply wire is smaller than a thickness of the insulating material of the insulated electric wire constituting the signal wire.

9. A movable part composite cable, comprising:

a plurality of power supply wires being designed for electric power supply, which respectively include a plurality of insulated electric wires being laid together and being covered by each covering member, the plurality of power supply wires being arranged in contact with each other on surfaces of their respective covering members;

one or more signal wires being designed for signal transmission, each signal wire having an outer diameter smaller than an outer diameter of each power supply wire; and a jacket, which is being provided over an outer periphery of an aggregate including the plurality of power supply wires and the one or more signal wires that are laid together, wherein the power supply wires and the signal wires are not in direct contact with each other, or the power supply wires and the signal wires are in direct contact with each other with a contact area therebetween being smaller than a contact area between the power supply wires, wherein each signal wire includes a plurality of insulated electric wires laid together, each of which comprises a stranded wire conductor and an insulating material coating a periphery of the stranded wire conductor, and wherein a lay direction of the plurality of insulated electric wires of each of the signal wires is configured to be an opposite direction to a lay direction of each stranded wire conductor of the insulated electric wire and a lay direction of the aggregate.

10. A movable part composite cable, comprising:

a plurality of power supply wires being designed for electric power supply, which respectively include a plurality of insulated electric wires being laid together and being covered by each covering member, the plurality of power supply wires being arranged in contact with each other on surfaces of their respective covering members;

one or more signal wires being designed for signal transmission, each signal wire having an outer diameter smaller than an outer diameter of each power supply wire; and a jacket, which is being provided over an outer periphery of an aggregate including the plurality of power supply wires and the one or more signal wires that are laid together, wherein the power supply wires and the signal wires are not in direct contact with each other, or the power supply wires and the signal wires are in direct contact with each other with a contact area therebetween being smaller than a contact area between the power supply wires, a bundle shield layer comprising a braided shield composed of braided metal wires, and being provided over the outer periphery of the aggregate, wherein each of the signal wires includes a plurality of insulated electric wire being laid together, and a signal wire side shield layer comprising a braided shield composed of braided metal wires and being provided over an outer periphery of the plurality of insulated electric wires, wherein a thickness of the bundle shield layer is greater than thicknesses of the respective signal wire side shield layers of the signal wires.

11. A movable part composite cable, comprising:

a plurality of power supply wires being designed for electric power supply, which respectively include a plurality of insulated electric wires being laid together and being covered by each covering member, the plurality of power supply wires being arranged in contact with each other on surfaces of their respective covering members;

one or more signal wires being designed for signal transmission, each signal wire having an outer diameter smaller than an outer diameter of each power supply wire; and a jacket, which is being provided over an outer periphery of an aggregate including the plurality of power supply wires and the one or more signal wires that are laid together, wherein the power supply wires and the signal wires are not in direct contact with each other, or the power supply wires and the signal wires are in direct contact with each other with a contact area therebetween being smaller than a contact area between the power supply wires, a bundle shield layer comprising a braided shield composed of braided metal wires, and being provided over the outer periphery of the aggregate, wherein each of the signal wires includes a plurality of insulated electric wire being laid together, and a signal wire side shield layer comprising a braided shield composed of braided metal wires and being provided over an outer periphery of the plurality of insulated electric wires, wherein outer diameters of the metal wires constituting the bundle shield layer are greater than outer diameters of the metal wires constituting the respective signal wire side shield layers of the signal wires.

* * * * *